29-400 N AU 32( EM
4/15/86 XP 4,581,817

United States Patent [19]

Kelly

[11] Patent Number: 4,581,817

[45] Date of Patent: Apr. 15, 1986

[54] DRAWBAR SWAGING APPARATUS WITH SEGMENTED CONFINEMENT STRUCTURE

[75] Inventor: John W. Kelly, Burbank, Calif.

[73] Assignee: Haskel, Inc., Burbank, Calif.

[21] Appl. No.: 476,492

[22] Filed: Mar. 18, 1983

[51] Int. Cl.[4] ..... B23P 15/26

[52] U.S. Cl. ..... 29/727; 29/157.3 C; 29/400 N; 29/523; 277/119; 285/222; 285/382.4

[58] Field of Search ..... 29/157.3 C, 727, 726, 29/523, 400 N; 72/60, 370, 56, 57, 58, 62; 285/222, 382.4; 165/173, 175; 277/216, 217, 218, 219, 220, 221, 222, 223, 224

[56] References Cited

U.S. PATENT DOCUMENTS

| | | | |
|---|---|---|---|
| 525,588 | 9/1894 | Bryant | 277/121 |
| 717,008 | 12/1902 | Lochridge et al. | 277/118 |
| 724,074 | 3/1903 | Allen | 277/121 |
| 911,228 | 2/1909 | Fulford | 277/122 |
| 947,889 | 2/1910 | Dorsey | 277/121 |
| 1,720,563 | 7/1929 | Neal | 277/121 |
| 2,118,855 | 5/1938 | Miller | 277/119 |
| 2,460,580 | 2/1949 | Huber | 285/222 X |
| 2,546,377 | 3/1951 | Turechek | 277/117 X |
| 3,186,681 | 6/1965 | Lowery | 277/117 X |
| 3,215,205 | 11/1965 | Sizer | 277/121 X |
| 3,302,736 | 2/1967 | Kisling, II | 277/117 X |
| 4,186,584 | 2/1980 | Schott | 29/727 X |
| 4,328,974 | 5/1982 | White et al. | 277/122 |
| 4,387,507 | 6/1983 | Kelly | 72/58 X |
| 4,388,752 | 6/1983 | Vinciguerra et al. | 29/523 X |
| 4,418,457 | 12/1983 | Mueller | 29/727 X |
| 4,420,866 | 12/1983 | Mueller | 29/523 X |
| 4,422,317 | 12/1983 | Mueller | 72/58 |

FOREIGN PATENT DOCUMENTS

| | | | |
|---|---|---|---|
| 923964 | 7/1949 | Fed. Rep. of Germany . | |
| 7202510 | 1/1972 | Fed. Rep. of Germany . | |
| 24742 | 2/1980 | Japan | 29/523 |
| 405210 | 9/1964 | Switzerland . | |
| 2074914 | 5/1980 | United Kingdom . | |

OTHER PUBLICATIONS

Bulletin EA-175, Positrol, Inc. (1974).

"Erickson Expanding Mandrels", Erickson Tool Co., Solon, OH.

*Primary Examiner*—Howard N. Goldberg
*Assistant Examiner*—Ronald S. Wallace
*Attorney, Agent, or Firm*—Pretty, Schroeder, Brueggemann & Clark

[57] ABSTRACT

A swaging apparatus includes a drawbar to be inserted in a tubular structure that is to be expanded radially. Two confinement structures define the axial boundaries of an annular pressure zone within which one or more elastically deformable pressurization rings are confined. One or both of these structures includes a plurality of arcuate segments elastically held together and presenting a cam surface. A cam ring interacts with that cam surface to radially expand a cylinder formed by the segments in response to swaging pressure, thereby preventing inelastic deformation of the pressurization rings.

6 Claims, 6 Drawing Figures

DRAWBAR SWAGING APPARATUS WITH SEGMENTED CONFINEMENT STRUCTURE

FIELD OF THE INVENTION

The present invention relates to swaging apparatus for causing radial expansion of tubular structures, and, more particularly, to such apparatus in which a drawbar to be inserted in the structure is encircled by elastically deformable pressurization rings by which the pressure is applied.

BACKGROUND OF THE INVENTION

There are a variety of situations in which it is desired to expand a tube radially to form a tight, leak-free joint. For example, large heat exchangers, particularly the type used as steam generators in nuclear power plants, often employ a tube sheet, which is a steel plate several feet thick, through which hundreds of stainless steel or carbon steel tubes must pass. The tube sheet is initially fabricated with bores of a suitable diameter in which the tubes are inserted. The tubes are then expanded radially against the sides of the bores by plastic deformation to permanently seal the small crevices that would otherwise exist around the tubes. If these crevices were allowed to remain, they could collect corrosive agents, and would, therefore, decrease the reliable and predictable life-expectancy of the equipment.

One known type of swaging apparatus employs a drawbar encircled by elastically deformable rings, which may be made of polyurethane. The drawbar is inserted axially into the structure to be expanded and is then retracted into a head, causing the pressurization rings to be compressed axially and expanded radially. Apparatus of this type may be used to perform the entire swaging operation, or it may advantageously be used to perform a preliminary step followed by hydraulic swaging, particularly in high pressure applications.

When a typical tubular structure expands under swaging pressure, the expansion does not end abruptly at the ends of the intended pressure zone defined by the outer ends of the outermost pressurizing rings. Instead, the structure in which the drawbar is inserted is expanded beyond the pressure zone, with the expansion tapering off gradually along a transitional portion to the unexpanded diameter. The application of swaging pressure therefore creates an annular void at each end of the intended pressure zone within the transitional portions of the swaged structure.

At extremely high pressures, the pressurization rings tend to behave as a liquid and deform to fill any available voids. Thus a ring adjacent a void will often be extruded into the void. The shape and depth of the voids created in a typical swaging situation is such that the elastic limits of the material are exceeded. The apparatus can be permanently damaged and it may be difficult to remove the apparatus from the expanded structure.

An objective of the present invention is to provide an improved drawbar swaging apparatus in which the problem of destructive inelastic extrusion of the pressurization ring or rings is minimized or eliminated.

SUMMARY OF THE INVENTION

The present invention accomplishes the above objective. A swaging apparatus includes a drawbar to be inserted axially in a tubular structure to be expanded radially. The drawbar extends from a head and is encircled by at least one elastically deformable pressurization ring. Means are included for retracting the drawbar into the head, whereby the pressurization ring is compressed axially and expanded radially.

Confinement means that confine the pressurization ring axially to prevent inelastic deformation include a plurality of arcuate segments arranged to form a cylinder encircling the drawbar and cam means for spreading the segments radially in response to an axial force.

According to another aspect of the invention, the segments are secured and urged against the drawbar by an encircling resilient band, preferably made of polyurethane. The band may be received by an annular groove in the outside of the segments. When the segments move radially they pivot on the heal ends and radial segment movement takes place at the ends closest to the pressure zone.

Preferably, the cam means used to engage and spread the segments is an inelastic ring disposed between the segments on one side and the pressurization ring on the other. Conical cam surfaces defined by the segments and the cam ring engage each other to produce an outwardly directed radial force applied to the segments in response to an axial force applied to the drawbar to compress the pressurization rings.

According to still another aspect of the invention, the cam ring includes an elongated foot that extends axially along the drawbar. Although the cam ring can slide on the drawbar, it cannot move angularly. It, therefore, performs a centering function producing symetrical movement of the segments. The foot is received by an annular recess formed by undercut portions of the segments at the ends thereof nearest the pressurization ring.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
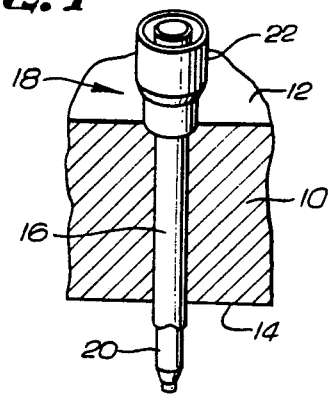
FIG. 1 is a perspective view of a swaging apparatus constructed in accordance with the invention inserted in a tube in a bore of a tube sheet, only a fragmentary portion of the tube sheet being shown and being broken away to expose the apparatus.

A steel tube sheet 10 of the type used in heat exchangers, such as those that form part of nuclear power plants, has a plurality of bores that extend through it perpendicularly to its primary and secondary surfaces 12 and 14, respectively. A plurality of steel tubes 16 are positioned in these bores to be expanded radially by swaging to form leak-proof joints that prevent fluid from migrating from the primary side 14 of the exchanger to the secondary side 12. A fragmentary portion of the tube sheet 10 receiving a single tube 16 is shown in FIG. 1.

Figure 2:
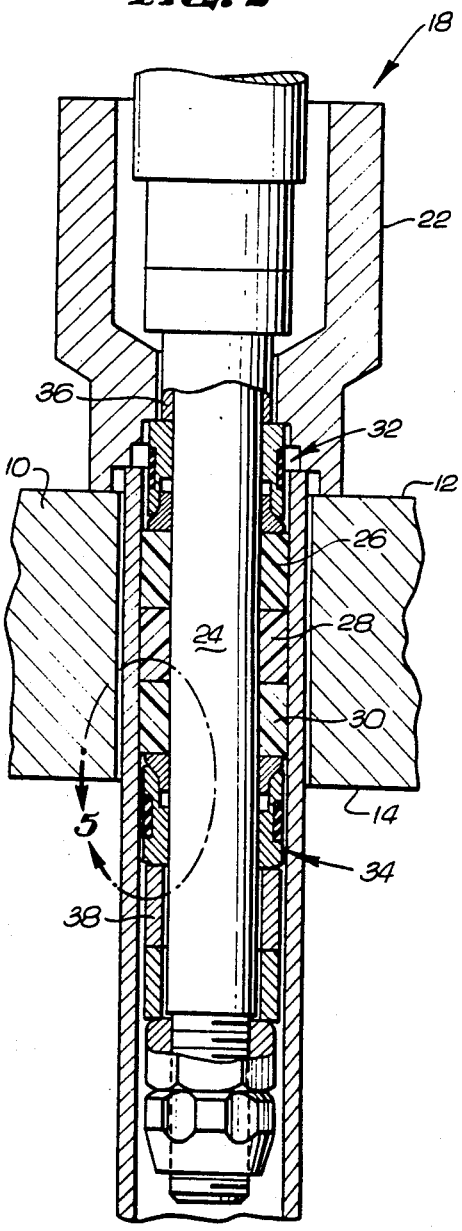
FIG. 2 is a longitudinal cross-sectional view of the swaging apparatus, tube, and tube sheet of FIG. 1, the apparatus being in position to begin swaging.

A swaging apparatus 18, including an elongated generally cylindrical drawbar 20 and a head 22, is inserted axially in the tube 16 from the primary side 12 of the tube sheet 10, as best shown in FIG. 2. Only a small annular clearance exists between the drawbar 22 and the tube 16 to permit insertion.

The drawbar 20 has a central section 24 that is encircled by three polyurethane pressurization rings 26, 28, and 30, the intended pressure zone of the apparatus 18 being coextensive with these rings. At each end of the pressure zone is a confinement structure 32 or 34 that positions the rings 26, 28 and 30. The drawbar 22 includes separately formed annular shoulder members 36 and 38 by which the confinement means are prevented from moving axially toward the ends of the drawbar.

When swaging pressure is to be applied, the drawbar 20 is retracted by a hydraulic piston (not shown) attached to the drawbar in the head 22, the rings 26, 28, and 30 expand outwardly, and the tube 16 is deformed radially outwardly. The bore is then enlarged by deforming the tube 16 and the tube sheet 10. Preferably the tube 16 exceeds its elastic limits but the tube sheet 10 does not, so that the tube is permanently clamped in place where the swaging pressure is removed and the tube sheet 10 returns to its original shape.

Due to the high swaging pressure, the pressurization rings 26 and 30 at the ends of the pressure zone could be deformed inelastically and destructively into any void between the drawbar 22 and the tube 16 in the transitional areas where the expanded inside diameter of the tube 16 tapers down to the unexpanded diameter. These potential voids are blocked, however, by the action of the confinement structures 32 and 34.

Figure 5:
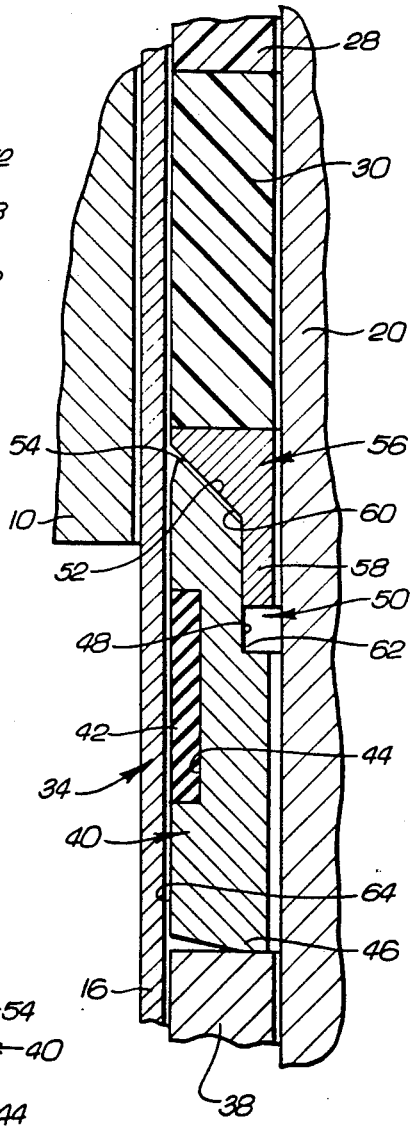
FIG. 5 is an enlargement of a fragmentary portion of the structure of FIG. 2 indicated by the arrow 5.
Figure 6:
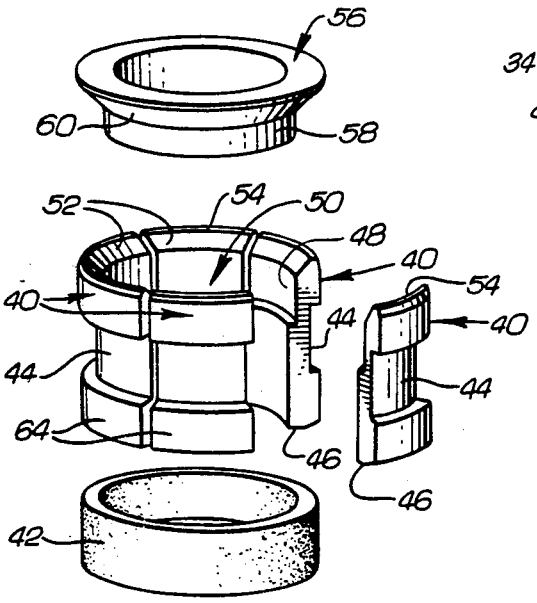
FIG. 6 is an exploded view of the confinement means of FIG. 2.

Since the two confinement structures 32 and 34 are alike, only one of these structures 34, best shown in FIG. 5, is described in detail. It is formed by a plurality of separate arcuate segments 40 assembled side by side to form a cylinder that encircles the drawbar 22. The segments 40 are first manufactured as a complete integral cylinder which is then cut longitudinally to separate the individual segments (see FIG. 6).

When the segments 40 are assembled about the drawbar 22, they are secured and urged inwardly by an encircling resilient polyurethane band 42 that is stretched about thirty to fifty percent from its relaxed diameter. The band 42 is recieved by a circumferential groove 44 on the outside of the segments 40. Adjacent the heel end 46 is the shoulder piece 38 that restrains the confinement structure 34 against axial movement along the drawbar 22.

At the other end of each segment 40 is an undercut portion 48, all the undercuts collectively defining an annular recess 50 opening toward the pressure zone. At the mouth of the recess 50 is a conical cam surface 52 that is inclined radially outwardly and toward the pressure zone forming a pointed circumferential edge 54 at the end of the confinement structure 34 adjacent the pressurization ring 30. Between the pressurization ring 30 and the segments 40 is a steel cam ring 56 with an elongated cylindrical foot 58 that extends well into the recess 50 and a conical cam surface 60 projecting outwardly from the foot to the edge 54. Within this environment the cam ring 56 is referred to an inelastic since it does not deform under swaging pressure.

When no swaging pressure is being applied by the drawbar 22 (as in FIGS. 2 and 5), the segments 40 are held inwardly against the drawbar in a generally cylindrical configuration by the band 42, the mating conical cam surfaces 52 and 60 of the segments 40 and the cam ring 56 being parallel and in full engagement with each other. An unused travel space 62 remains within the recess 50 at the far end of the foot 58, as best shown in FIG. 5.

Figure 3:
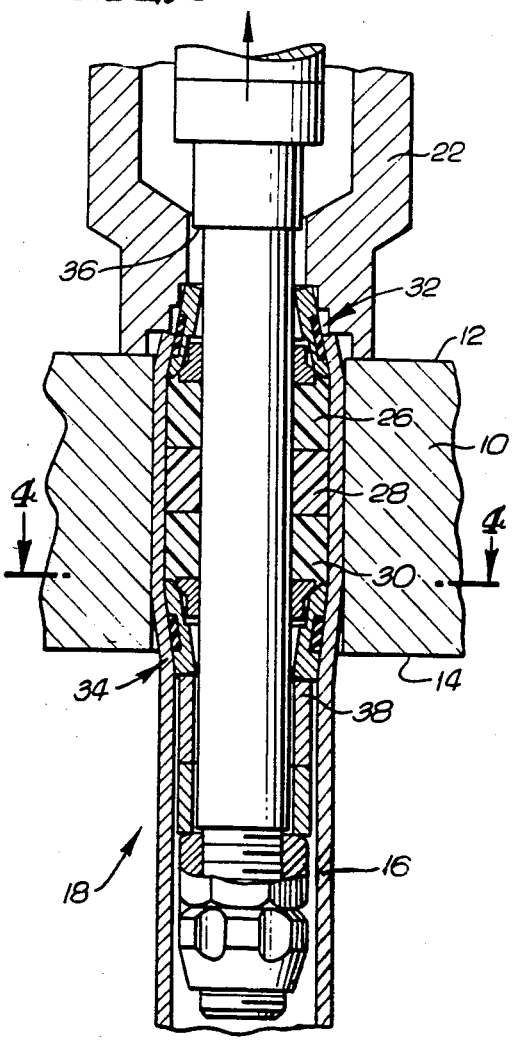
FIG. 3 is another longitudinal cross-sectional view similar to FIG. 2 showing the apparatus, tube, and tube sheet after swaging has taken place and while the swaging pressure is still being applied.

Upon the application of swaging pressure by axial movement of the drawbar 22, the pressurization rings 26, 28, and 30 are compressed axially and expanded radially. Accordingly, the axial pressure applied by the outermost pressurization ring 30 to the adjacent confinement structure 34 causes the foot 58 of the cam ring 56 to move into the travel space 62. The interaction of the cam surfaces 52 and 60 causes the segments 40 to pivot at the heel ends 46 (see FIG. 3), the back surfaces 64 of the segments being angled away from the shoulder piece 38 to permit this pivotal motion. As the segments 40 move outwardly, giving the confinement structure 34 a slightly conical overall shape, the band 42 is stretched by a small amount.

Figure 4:
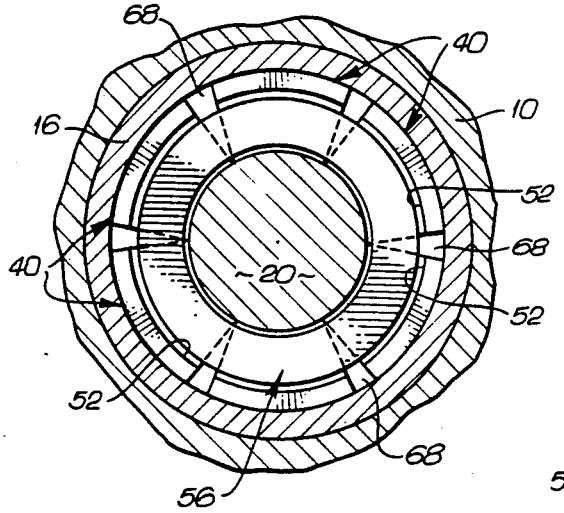
FIG. 4 is a transverse cross-sectional view of the apparatus, tube, and tube sheet taken along the line 4—4 of FIG. 3.

The manner in which the confinement structure 34 prevents extrusion of the pressurization ring 30 is best understood with reference to the cross-sectional view of FIG. 4. The annular gap that would otherwise be presented to the ring 30 is largely closed by the support segments 40, and only small open areas 68 exist between adjacent segments. Not only is the maximum size of any unsupported areas 68 greatly reduced, but the shape of these small areas is highly advantageous in preventing inelastic deformation or extrusion of the pressurization ring 30.

The sensitivity of materials such as polyurethane to the size and shape of gaps or voids to which they are exposed under pressure is known. In the absence of the confinement structure 34, the unsupported area of the last pressurization ring 30 would be connected to the supported area of the same ring only along a circular edge and would extend uninterrupted about the entire circumference of the drawbar 22, permitting an annular extrusion. Relatively little resistance would be offered to such extrusion. In contrast, the separated, unsupported surfaces of the ring 30 corresponding to the small gaps 68 are each connected along three of their four sides. The combined area of these gaps 68 is comparatively small. Moreover, the maximum unsupported dimension is merely the diagonal of each small gap 68, which is almost insignificant when compared to the circumference of the drawbar 22. Thus the tendency of the ring 30 to extrude and deform inelastically at swaging pressure can be effectively eliminated by the presence of the segmented confinement structure 34.

It should be noted that the small gaps 68 are each of the same size, and it would be disadvantageous if they were not, since the tendency of the pressurization ring 30 to extrude destructively is determined by the largest gap presented. Uniformity of the gaps 68 is maintained because the segments 40 cannot rotate about the drawbar 22 relative to each other. They are locked in relative position because they are in tight contact with each other at the heel ends 46. The band 42 produces a positive action securing the segments 40 in their relative positions with the heel ends 46 pushed together.

The cam ring 56 also tends to center the drawbar 22 within the tube 16. This centering effect takes place because the cam ring 56 has a close sliding fit on the drawbar 22 and cannot be cocked angularly because of its substantial length. It therefore forces each segment 40 to move radially by an equal distance, maintaining the symmetry of the confinement structure 34 as that structure assumes a conical shape.

The apparatus 18 of the present invention can be used repeatedly at high swaging pressures without the need to replace the pressurization rings 26, 28, and 30 or any other components. It is of relatively simple and reliable construction considering the pressures at which it is capable of operating and is capable of being reused repeatedly.

While a particular form of the invention has been illustrated and described, it will be apparent that various modifications can be made without departing from the spirit and scope of the invention.

I claim:

1. A swaging apparatus for radially expanding a tubular structure comprising:

a head;

an elongated drawbar extending from said head for axial insertion in said tubular structure;

at least one elastically deformable pressurizing ring encircling said drawbar;

confinement means for providing an annular abutment surface facing toward said pressurizing ring, thereby confining said pressurizing ring axially and preventing inelastic deformation thereof, said confinement means including a plurality of separate arcuate inelastic segments arranged to form a cylinder encircling said drawbar, each of said segments having an inclined cam surface thereon defining a portion of said abutment surface, a resilient band encircling said segments and thereby urging said segments radially inwardly toward said drawbar, cam means encircling said drawbar and in contact with said pressurizing ring and said segments for spreading said segments at the ends thereof closest tc said pressurizing ring and thereby causing said segments to pivot on the ends thereof farthest from said pressurizing ring in response to an axial force applied thereto as said pressurizing ring is compressed axially.

2. The apparatus of claim 1 wherein said cam means has a foot portion extending axially along said drawbar to prevent angular movement of said cam means relative to said drawbar.

3. The apparatus of claim 6 wherein said cam means has a conical surface thereon configured to engage and mate with said cam surfaces of said segments.

4. The apparatus of claim 1 wherein said resilient band is made of polyurethane.

5. A swaging apparatus for radially expanding a tubular structure comprising:

a head;

an elongated drawbar extending from said head for axial insertion in said tubular structure;

at leaast one elastically deformable pressurizing ring encircling said drawbar;

means for retracting said drawbar toward said head whereby said pressuring ring is compressed axially and expanded radially; and a pair of separated confinement structures providing annular abutment surfaces facing toward said pressurizing ring and thereby defining the axial boundaries of a pressure zone within which said pressurizing ring is confined, each of said confinement structures including (a) a plurality of separate arcuate inelastic steel segments arranged to form a cylinder surrounding said drawbar and defining a circumferential groove on the outer surfaces thereof, an undercut annular recess opening toward said pressure zone, and a first conical cam surface located at the mouth of said recess and at the ends of said segments closest to said pressure zone; (b) a resilient polyurethane band disposed within said groove and urging said segments inwardly against said drawbar; and (c) an inelastic steel cam ring means having an elongated foot extending along said drawbar into said recess and a second conical cam surface engaging said first cam surface for spreading said segments at the ends thereof closest to said pressure zone and thereby causing said segments to pivot on the ends thereof farthest from said pressure zone, whereby inelastic deformation of said pressurizing ring is prevented.

6. A swaging apparatus for radially expanding a tubular structure comprising:

a head;

an elongated drawbar extending from said head for axial insertion in said tubular structure;

at least one elastically deformable pressurizing ring encircling said drawbar;

confinement means for providing an annular abutment surface facing toward said pressurizing ring, thereby confining said pressurizing ring axially and preventing inelastic deformation thereof, said confinement means including a plurality of separate arcuate inelastic segments arranged to form a cylinder encircling said drawbar, each of said segments having an inclined cam surface thereon defining a portion of said abutment surface and each of said segments having a groove thereon defining a portion of an annular groove encircling said cylinder, a resilient band disposed within said groove and encircling said segments and thereby urging said segments radially inwardly toward said drawbar, cam means encircling said drawbar and in contact with said pressurizing ring and said segments for spreading said segments at the end thereof closest to said pressurizing ring and thereby causing said segments to pivot on the ends thereof farthest from said pressurizing ring in response to an axial force applied thereto as said pressurizing ring is compressed axially.

* * * * *